US005203396A

United States Patent [19]

VanRens et al.

[11] Patent Number: 5,203,396

[45] Date of Patent: Apr. 20, 1993

[54] VACUUM VALVE FOR DIE CASTING

[75] Inventors: Russell J. VanRens, Milwaukee, Wis.; James M. Rumford, Waukegan, Ill.; Thornton E. Schultz, Kenosha, Wis.

[73] Assignee: Outboard Marine Corporation, Waukegan, Ill.

[21] Appl. No.: 874,629

[22] Filed: Apr. 27, 1992

[51] Int. Cl.[5] ..... B22D 17/14; B22D 17/20

[52] U.S. Cl. ..... 164/305; 164/253

[58] Field of Search ..... 164/305, 410, 253, 254, 164/61, 63, 65, 113

[56] References Cited

U.S. PATENT DOCUMENTS

| | | | |
|---|---|---|---|
| 4,431,047 | 2/1984 | Takeshima et al. | 164/253 |
| 4,463,793 | 8/1984 | Thurner . | |
| 4,538,666 | 9/1985 | Takeshima et al. | 164/305 |
| 4,691,755 | 9/1987 | Kuriyama et al. | 164/305 |
| 4,722,385 | 2/1988 | Yamauchi et al. | 164/305 |
| 5,022,457 | 6/1991 | Iwamoto et al. . | |

FOREIGN PATENT DOCUMENTS

| | | | |
|---|---|---|---|
| 62-214861 | 9/1987 | Japan | 164/305 |
| 63-93462 | 4/1988 | Japan | 164/305 |
| 2-192866 | 7/1990 | Japan | 164/305 |

*Primary Examiner*—J. Reed Batten, Jr.
*Attorney, Agent, or Firm*—Welsh & Katz, Ltd.

[57] ABSTRACT

The apparatus is used in die casting equipment of the type which utilizes a source of vacuum pressure in an internal die cavity for making a casting. The apparatus includes a valve body that has components that are separable along a split line that is positioned to enable easy cleaning of casting material from internal ports. The apparatus has a valve, a trap operatively connected to the valve body and a closed chamber with an inlet thereto. The chamber is adapted to receive and contain casting material that may enter the inlet thereof.

32 Claims, 3 Drawing Sheets

VACUUM VALVE FOR DIE CASTING

The present invention generally relates to die casting apparatus and more particularly relates to a vacuum valve that is useful for die casting operations.

It is generally known that metal die casting operations produce improved quality castings if the die cavity in which the casting is formed is evacuated of air prior to injection of the casting material into the cavity. While there have been many different designs for producing valves for communicating a source of vacuum with the die cavity, many of these designs have exhibited less than desirable operating characteristics and are often unreliable during use. One such vacuum valve generally comprises a reciprocating poppet valve which extends into the die cavity when it is opened and it is closed by the contact with the molten casting material that is injected into the cavity. Because there is a distinct tendency of molten material to flow behind the valve, it often does not seal properly because of the presence of such material. When the valve is contaminated, the die casting operation must be interrupted and the valve mechanism cleaned out which results in expensive down time and interferes with a desired production schedule.

Accordingly, it is an object of the present invention to provide an improved vacuum valve for die casting operations which valve exhibits reliable operation and is not easily obstructed or contaminated.

Another object of the present invention is to provide such an improved valve which in the event that it does become obstructed, is easily disassembled and cleaned.

Still another object of the present invention is to provide such an improved valve which is simple in design, and contains the capability of being effective in evacuating the die cavity which promotes improved quality castings, and yet is reliable in that if a malfunction occurs and the valve does not close at the appropriate time, casting material can be relatively easily removed. The valve contains a trap and filter arrangement which substantially prevents casting material from traveling along the line to the vacuum source.

Yet another object of the present invention lies in the provision of being able to inject air near the valve itself to cool the same and thereby contribute to reliable continued operation.

Still another object of the present invention lies in the provision of utilizing relatively common components that can be easily assembled and disassembled for maintenance and is economical in its construction.

Other objects and advantages will become apparent upon reading the following detailed description while referring to the attached drawings in which.

DETAILED DESCRIPTION

Broadly stated, the present invention relates to a vacuum valve apparatus for use in vacuum die casting equipment which is used to manufacture high quality cast products that do not have surface spalling and the like. Such surface anomalies are generally a result of air being present in the die cavity when the casting material is injected into the die cavity. The vacuum valve is used to communicate the die cavity with a source of vacuum for the purpose of evacuating air from the die cavity immediately prior to injection of the casting material into the die cavity. In a related application, a solenoid arrangement is disclosed in Ser. No. 874,755, which operates the valve in a manner whereby the valve can be very rapidly closed so that casting material will not impede the sealing of the poppet valve. It should be understood that in a die casting operation, the casting material is injected into the die cavity at extremely fast speed and under very high pressure. It is preferred that the injection of material occurs in approximately 30 milliseconds and that the vacuum valve of the present invention is desirably closed in approximately 15 milliseconds. By virtue of the solenoid valve invention of Ser. No. 874,755, such rapid movement of the poppet valve is possible.

The present invention is directed to the vacuum valve that has many desirable attributes in that it has a valve body that is comprised of two components which are separable so that in the event of a malfunction of the valve, the internal porting can be exposed and any casting material that may enter the valve body due to failure of the valve to seal can be relatively easily removed compared to known prior art designs. The valve also utilizes a relatively standard poppet valve that is quite similar to those used in automotive engines and is therefore relatively inexpensive, is sufficiently large so that the air in the die cavity can be rapidly evacuated thereby producing vacuum levels that are likely to produce high quality castings. The valve embodying the present invention includes a filter trap arrangement which prevents any casting material from traveling through the line to the source of the vacuum and it also has a means for injecting air under positive pressure into the area of the valve itself to cool the same.

Figure 1:
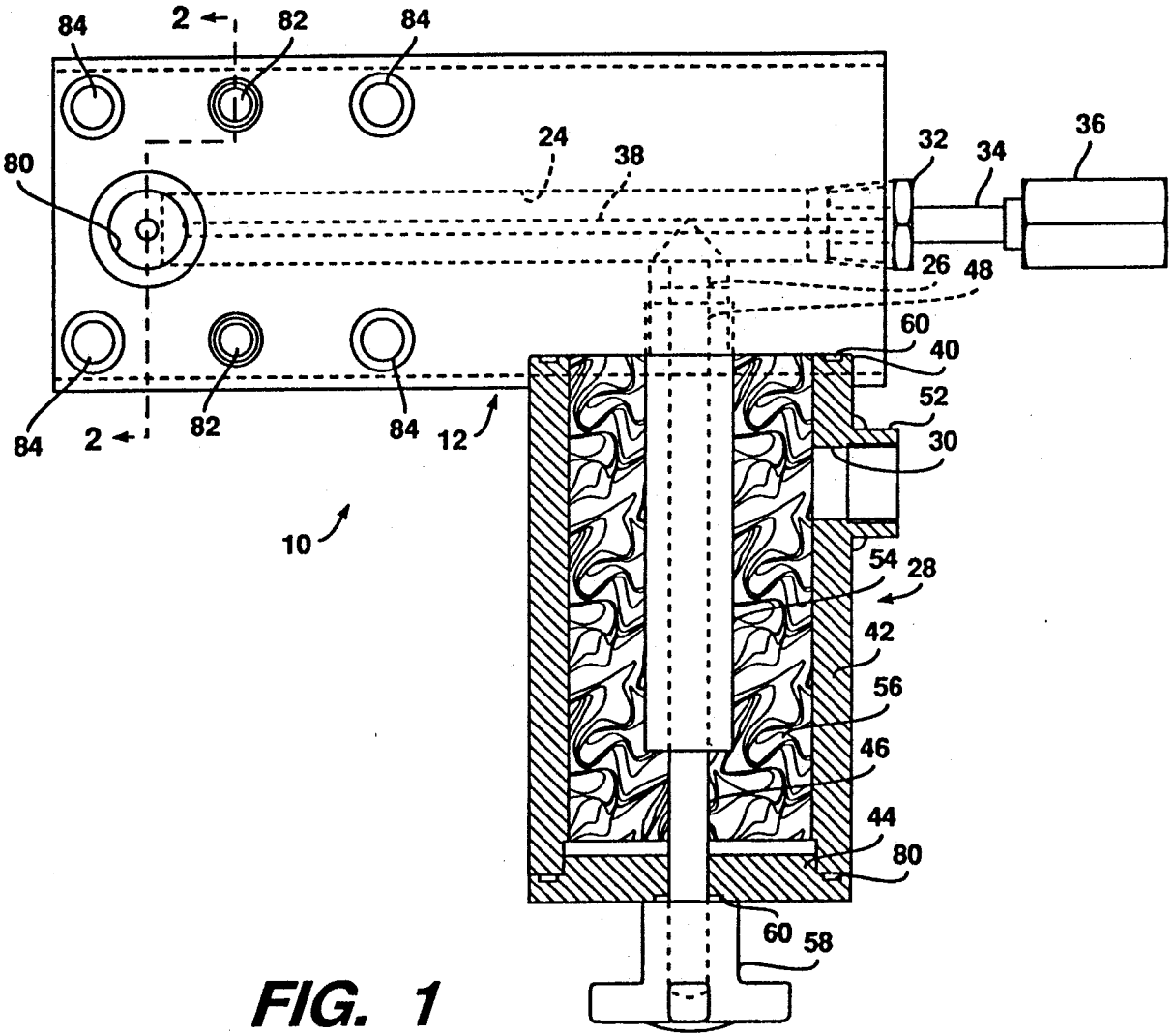
FIG. 1 illustrates a side elevation, partially in section, of the vacuum valve embodying the present invention.
Figure 2:
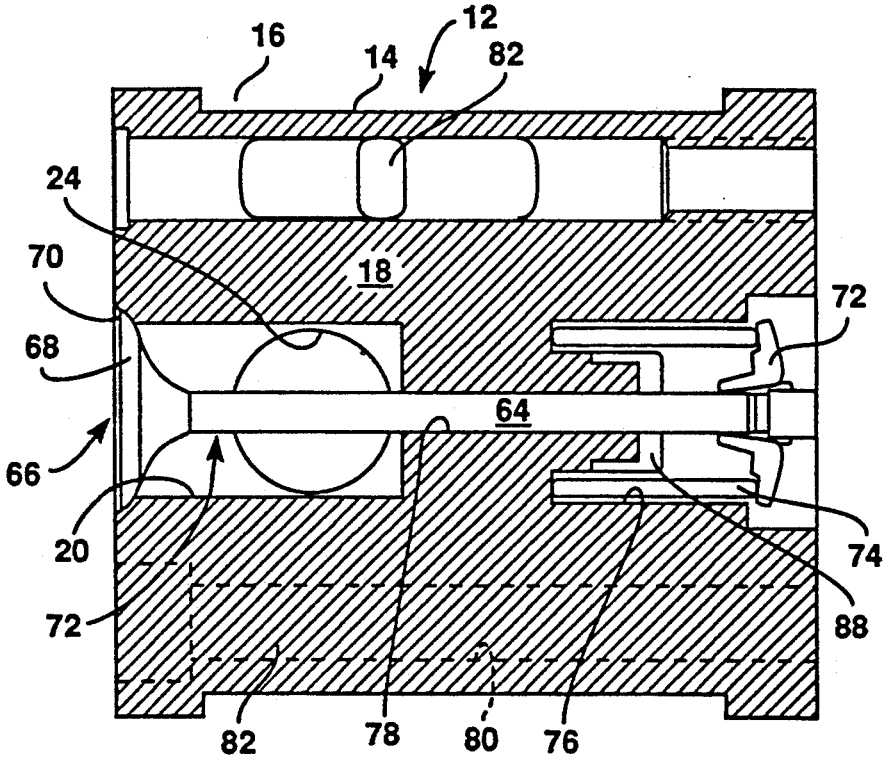
FIG. 2 is a cross section of a vacuum valve embodying the present invention and is taken generally along the line 2—2 of FIG. 1; and, FIG. 3 is an end view of the apparatus shown in FIG. 1, with the valve mechanism itself not being shown.

Turning now to the drawings, and particularly FIG. 1, the vacuum valve apparatus embodying the present invention is shown generally at 10, and includes a valve body, indicated generally at 12, which comprises two components 14 and 16 which are removably attached to one another along a split line 18, best shown in FIG. 2. As best shown in FIG. 2, the split line 18 is preferably located to bisect the port 24 equally so that if casting material does happen to enter into the port 24, separation of the components 14 and 16 will enable the material to be more easily removed from the sections of the components 14 and 16 along the port 24.

The valve body 12 has a first generally cylindrically shaped recess 20 which is located in the base of the valve and in which a poppet valve, indicated generally at 22, is located. The first recess 20 is in communication with a transverse recess 24 that extends to the opposite end of the valve body, i.e., the right end as shown in FIG. 1, and it also has a downward extending portion 26 that extends to the bottom thereof and is in communication with a filter trap mechanism, indicated generally at 28, which in turn has a port 30 that is connected to a line to a source of vacuum.

The portion of the port 24 that extends to the right in FIG. 1 beyond the downward extension 26 communicates with a source of positive air pressure via connector 32, a short nipple 34 and a bubbler connector 36 that in turn is connected to a source of positive air pressure. The port 24 includes an inner tube 38 through which air is communicated to the first port 20 for the purpose of directing air into the port 20 for cooling the valve 22.

The trap and filter mechanism 28 fits in a circular recess 40 in the valve body and the trap filter mechanism generally comprises a hollow cylindrical portion 42 having an end cap 44 that is removable and the trap filter mechanism is held to the valve body by a long bolt 46 having a threaded upper end 48 that engages a cooperatively threaded aperture 50 in the valve body.

Figure 3:
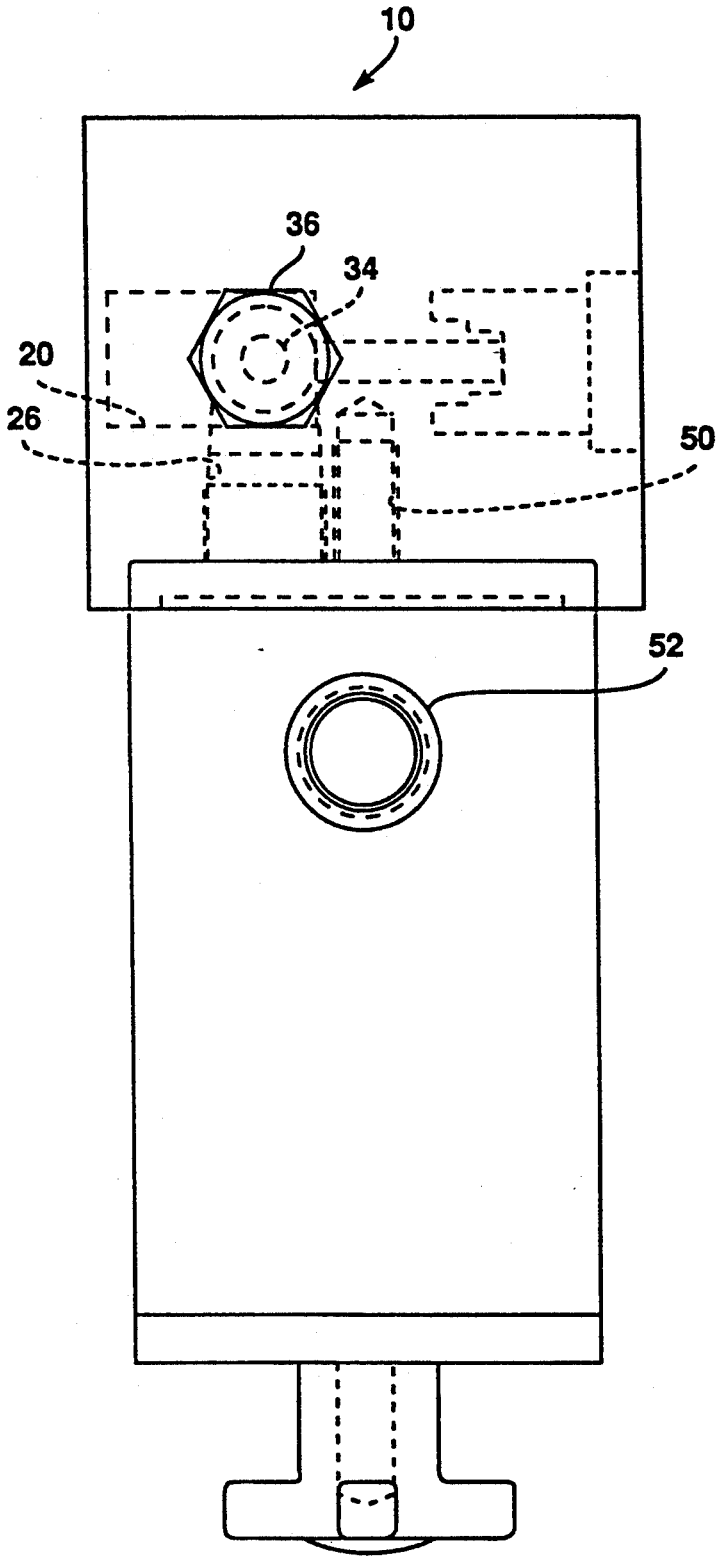

As is best shown in FIG. 3, the aperture 50 is laterally displaced from the port portion 26 so as to not interfere with the port portion 26. The cylinder 42 has a threaded nipple 52 welded thereto and it is adapted to receive a coupling of a line that extends to the source of vacuum (not shown). As is illustrated in FIGS. 1 and 3, the nipple 52 is located near the upper end of the trap so that if any casting material travels through the port 24 and port 26, it will be caught in the interior of the trap and will most probably travel to the bottom rather than going out of the port 30 to the source of vacuum. The trap filter mechanism 28 is sized sufficiently large so that the level of casting material would not reach the bottom of the aperture 30 and exit therefrom. Moreover, it is preferred that a tubular insert 54 be provided which fits within the port 26 so that any casting material would travel down the insert 54 into the bottom of the trap 42. While not entirely necessary, it is preferred that the interior of the trap filter be filled with steel wool 56 for the purpose of further protecting the vacuum pump. The bolt 46 has a handle 58 attached to it so that an operator can easily unscrew the bolt 46 and pull the trap filter away from the valve body if necessary. To prevent leakage, O-ring seals 60 are provided at the top of the cylindrical portion 42 and also in the bottom 44 and also around the bolt 46.

In accordance with an important aspect of the present invention, the poppet valve 22 comprises an elongated valve stem 64 and an enlarged head, indicated generally at 66, with the head having a beveled surface 68 that is of the same size and angular orientation with a similar bevel 70 located at the face of the port 20 so as to provide a sealing surface. At the opposite end of the stem, i.e., to the right as shown in FIG. 2, a spring retainer member 72 is provided and is attached to the stem in a conventional manner as is well known in the automotive art. A spring 74 is located in cylindrical recess 76 bears against the retainer member 72 and biases the valve 22 closed. The component 14 has a port 78 extending from the cylindrical recess 76 to the port 20 and is only slightly larger than the outside diameter of the valve stem 64 so that it can reciprocate within it.

The components 14 and 16 also have apertures 80 located within them adapted to receive cylindrical positioning mandrels 82 to accurately position the components relative to one another. After the mandrels 82 are inserted, then bolts 84 can be inserted in associated apertures for bolting the components together.

From the foregoing detailed description, it should be appreciated that an improved vacuum valve apparatus has been shown and described which offers many desirable advantages and attributes compared to prior valve designs. The apparatus provides adequate communication of vacuum so that the cavity will be quickly evacuated of air. The use of conventional valve components results in reliable performance at a reasonable cost. The use of valve body components that are separable at a desired position enables relatively easy clearing of internal ports that may be obstructed due to a malfunction during operation. The use of a trap effectively prevents damage to a vacuum source and provision is made for cooling the valve which contributes to its useful life.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. A vacuum valve apparatus for use in a die casting means, the die casting means being of the type which utilizes a source of vacuum pressure and a die body having internal surfaces which define an internal die cavity for making a casting, said apparatus comprising:

a valve body adapted to be at least partially located in the die body, said valve body having at least one face that is generally coextensive with an internal surface of the die body, said valve body having a first internal port means adapted to receive a valve means, a second internal port means communicating said first port means with a trap means and the source of vacuum pressure, said first port means terminating at said one face and being in communication with said die cavity;

an openable and closeable valve means housed in said first internal port means of said valve body and communicating said first port means with the die cavity when said valve means is open and isolating the first port means from the die cavity when said valve means is closed;

a trap means operatively connected to said valve body and having a closed chamber with an inlet thereto, said chamber being adapted to receive and contain casting material that may enter the inlet thereof, said inlet communicating said chamber with said second internal port means, said trap means having a vacuum port means for communicating the chamber with the source of vacuum pressure;

said valve body having at least two body components that are separable from one another along a split line, said split line being located along said second internal port means whereby the same is formed in each of said valve body components, so that separating said valve body exposes a substantial portion of at least said second internal port means to enable any casting material to be removed therefrom.

2. Apparatus as defined in claim 1 wherein said valve body includes a third internal port means for communicating said first port means to the exterior of said valve body.

3. Apparatus as defined in claim 2 wherein said third internal port means is connected to a pressure sensing means.

4. Apparatus as defined in claim 3 further including a conduit means located within said third internal port means for communicating a source of positive air pressure to said first internal port means.

5. Apparatus as defined in claim 1 wherein first internal port means is generally transverse to said second port means at the intersection of the two, said split line also being located so that portions of said first internal port means are located in each of said valve body components.

6. Apparatus as defined in claim 1 wherein one of said valve body components includes a plurality of threaded apertures, other of said valve body components having cooperative apertures aligned with said threaded apertures so that threaded bolt means can be inserted through said cooperative apertures into said threaded apertures to secure the valve body components together.

7. Apparatus as defined in claim 6 including at least two sets of locating apertures in each of said valve body components with one locating aperture of each set being positioned in each valve body component and being aligned with the other locating aperture of each set, the other locating aperture being positioned in an adjacent valve body component, and means adapted to be inserted into each set of aligned apertures to accurately position the valve body components relative to one another prior to insertion of said threaded bolt means.

8. Apparatus as defined in claim 1 wherein said trap means is removably attached to said valve body and includes means for attaching the same to said valve body.

9. Apparatus as defined in claim 8 wherein said chamber of said trap means is of sufficient capacity to contain substantially all of the casting material that would normally be placed in the die cavity during a die casting operation.

10. Apparatus as defined in claim 9 wherein said trap means generally comprises a hollow cylinder having one open end for contacting said valve body, said inlet comprising the open end, the end opposite said open end having a removable end cap, said attaching means comprising a threaded bolt means passing through an aperture in said end cap and extending into a cooperatively threaded aperture in said valve body to thereby hold said end cap and said cylinder to said valve body.

11. Apparatus as defined in claim 10 wherein said trap means is located below said valve body so that casting material passing through said inlet will be contained therein, said vacuum port means being located near the top portion of said cylinder to minimize the possibility of casting material passing from said trap means toward said source of vacuum pressure.

12. Apparatus as defined in claim 11 including sealing means are located at each end of said cylinder.

13. Apparatus as defined in claim 11 including loosely packed steel wool located within said closed chamber.

14. Apparatus as defined in claim 1 wherein said valve means comprises a poppet valve having an elongated valve stem and an enlarged valve head located at one end thereof, said valve means having a biasing means operatively connected to the end portion opposite said one end, said biasing means biasing said poppet valve toward a closed position.

15. Apparatus as defined in claim 14 wherein said first internal port means comprises a first enlarged portion located in said one face of said valve body, said first enlarged portion having a valve sealing surface adapted to retain and seat said poppet valve head, said first internal port means having a second enlarged portion in a second face of said valve body opposite said one face, said second enlarged portion receiving said biasing means, and a middle portion between said first and second enlarged portions, said middle portion having a size and cross sectional configuration to receive said valve stem in close fitting relation to enable sliding movement thereof while generally preventing fluid communication therethrough.

16. Apparatus as defined in claim 15 wherein said valve sealing surface has a conical shaped bevel, and said valve head has a similar cooperatively fitting shape.

17. Apparatus as defined in claim 15 wherein said second internal port means is connected to said first enlarged portion of said first internal port means.

18. A vacuum valve apparatus for use in a metal die casting machine, the die casting machine being of the type which has a die body having internal surfaces which define an internal die cavity for making a metal casting, the machine utilizing a source of vacuum pressure for evacuating the die cavity immediately before a casting operation, said apparatus comprising:

a valve body adapted to be at least partially located in the die body, said valve body having at least one face that is generally coextensive with an internal surface of the die body, said valve body having a first internal port means adapted to receive a valve means, a second internal port means communicating said first port means with the source of vacuum pressure, said first port means terminating at said one face and being in communication with said die cavity;

an openable and closeable valve means housed in said first internal port means of said valve body and communicating said first port means with the die cavity when said valve means is open and isolating the first port means from the die cavity when said valve means is closed;

said valve body having at least two body components that are separable from one another along a split line, said split line being located along said second internal port means whereby the same is formed in each of said valve body components, so that separating said valve body exposes a substantial portion of at least said second internal port means to enable any casting material to be removed therefrom.

19. Apparatus as defined in claim 1 further including a trap means operatively connected to said valve body and having a closed chamber with an inlet thereto, said chamber being adapted to receive and contain casting material that may enter the inlet thereof, said inlet communicating said chamber with said second internal port means, said trap means having a vacuum port means for communicating the chamber with the source of vacuum pressure.

20. Apparatus as defined in claim 18 wherein said valve body includes a third internal port means for communicating said first port means to the exterior of said valve body.

21. Apparatus as defined in claim 20 wherein said third internal port means is connected to a pressure sensing means.

22. Apparatus as defined in claim 21 further including a conduit means located within said third internal port means for communicating a source of positive air pressure to said first internal port means.

23. Apparatus as defined in claim 18 wherein first internal port means is generally transverse to said second port means at the intersection of the two, said split line also being located so that portions of said first internal port means are located in each of said valve body components.

24. Apparatus as defined in claim 18 wherein one of said valve body components includes a plurality of threaded apertures, other of said valve body components having cooperative apertures aligned with said threaded apertures so that threaded bolt means can be inserted through said cooperative apertures into said threaded apertures to secure the valve body components together.

25. Apparatus as defined in claim 24 including at least two sets of locating apertures in each of said valve body components with one locating aperture of each set being positioned in each valve body component and being aligned with the other locating aperture of each set, the other locating aperture being positioned in an adjacent valve body component, and means adapted to be inserted into each set of aligned apertures to accurately position the valve body components relative to one another prior to insertion of said threaded bolt means.

26. Apparatus as defined in claim 19 wherein said trap means is removably attached to said valve body and includes means for attaching the same to said valve body.

27. Apparatus as defined in claim 26 wherein said trap means generally comprises a hollow cylinder having one open end for contacting said valve body, said inlet comprising the open end, the end opposite said open end having a removable end cap, said attaching means comprising a threaded bolt means passing through an aperture in said end cap and extending into a cooperatively threaded aperture in said valve body to thereby hold said end cap and said cylinder to said valve body.

28. Apparatus as defined in claim 27 wherein said trap means is located below said valve body so that casting material passing through said inlet will be contained therein, said vacuum port means being located near the top portion of said cylinder to minimize the possibility of casting material passing from said trap means toward said source of vacuum pressure.

29. Apparatus as defined in claim 18 wherein said valve means comprises a poppet valve having an elongated valve stem and an enlarged valve head located at one end connected to the end portion opposite said one end, said biasing means biasing said poppet valve toward a closed position.

30. Apparatus as defined in claim 31 wherein said first internal port means comprises a first enlarged portion located in said one face of said valve body, said first enlarged portion having a valve sealing surface adapted to retain and seat said poppet valve head, said first internal port means having a second enlarged portion in a second face of said valve body opposite said one face, said second enlarged portion receiving said biasing means, and a middle portion between said first and second enlarged portions, said middle portion having a size and cross sectional configuration to receive said valve stem in close fitting relation to enable sliding movement thereof while generally preventing fluid communication therethrough.

31. Apparatus as defined in claim 30 wherein said valve sealing surface has a conical shaped bevel, and said valve head has a similar cooperatively fitting shape.

32. Apparatus as defined in claim 30 wherein said second internal port means is connected to said first enlarged portion of said first internal port means.

* * * * *

UNITED STATES PATENT AND TRADEMARK OFFICE

CERTIFICATE OF CORRECTION

PATENT NO. : 5,203,396

DATED : April 20, 1993

INVENTOR(S) : VanRens et al

It is certified that error appears in the above-indentified patent and that said Letters Patent is hereby corrected as shown below:

Please delete title page and replace with attached title page.

Please delete Fig. 2 and replace with attached Fig. 2

Signed and Sealed this

Thirteenth Day of December, 1994

*Attest:*

*Attesting Officer*

BRUCE LEHMAN

*Commissioner of Patents and Trademarks*

United States Patent [19]

VanRens et al.

[11] Patent Number: 5,203,396

[45] Date of Patent: Apr. 20, 1993

[54] VACUUM VALVE FOR DIE CASTING

[75] Inventors: Russell J. VanRens, Milwaukee, Wis.; James M. Rumford, Waukegan, Ill.; Thornton E. Schultz, Kenosha, Wis.

[73] Assignee: Outboard Marine Corporation, Waukegan, Ill.

[21] Appl. No.: 874,629

[22] Filed: Apr. 27, 1992

[51] Int. Cl.[5] ..... B22D 17/14; B22D 17/20

[52] U.S. Cl. ..... 164/305; 164/253

[58] Field of Search ..... 164/305, 410, 253, 254, 164/61, 63, 65, 113

[56] References Cited

U.S. PATENT DOCUMENTS

| | | | |
|---|---|---|---|
| 4,431,047 | 2/1984 | Takeshima et al. | 164/253 |
| 4,463,793 | 8/1984 | Thurner . | |
| 4,538,666 | 9/1985 | Takeshima et al. | 164/305 |
| 4,691,755 | 9/1987 | Kuriyama et al. | 164/305 |
| 4,722,385 | 2/1988 | Yamauchi et al. | 164/305 |
| 5,022,457 | 6/1991 | Iwamoto et al. . | |

FOREIGN PATENT DOCUMENTS

| | | | |
|---|---|---|---|
| 62-214861 | 9/1987 | Japan | 164/305 |
| 63-93462 | 4/1988 | Japan | 164/305 |
| 2-192866 | 7/1990 | Japan | 164/305 |

*Primary Examiner*—J. Reed Batten, Jr.

*Attorney, Agent, or Firm*—Welsh & Katz, Ltd.

[57] ABSTRACT

The apparatus is used in die casting equipment of the type which utilizes a source of vacuum pressure in an internal die cavity for making a casting. The apparatus includes a valve body that has components that are separable along a split line that is positioned to enable easy cleaning of casting material from internal ports. The apparatus has a valve, a trap operatively connected to the valve body and a closed chamber with an inlet thereto. The chamber is adapted to receive and contain casting material that may enter the inlet thereof.

32 Claims, 3 Drawing Sheets

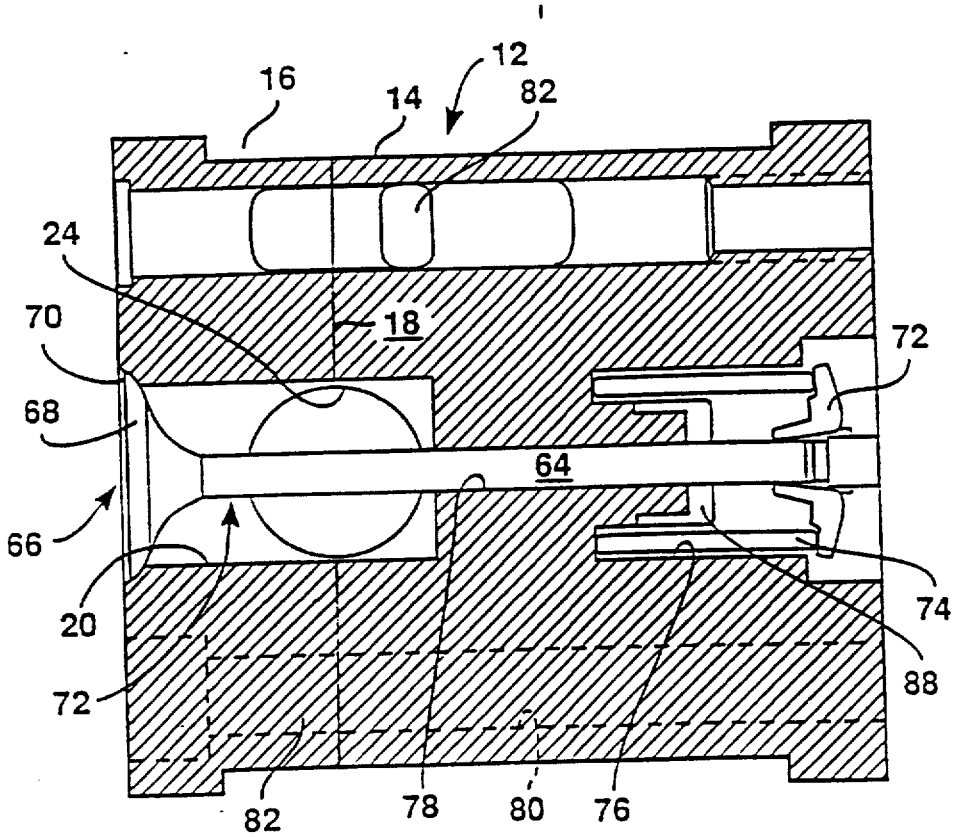

UNITED STATES PATENT AND TRADEMARK OFFICE

CERTIFICATE OF CORRECTION

PATENT NO. : 5,203,396 Page 3 of 3

DATED : April 20, 1993

INVENTOR(S) : VanRens et al.

It is certified that error appears in the above-identified patent and that said Letters Patent is hereby corrected as shown below:

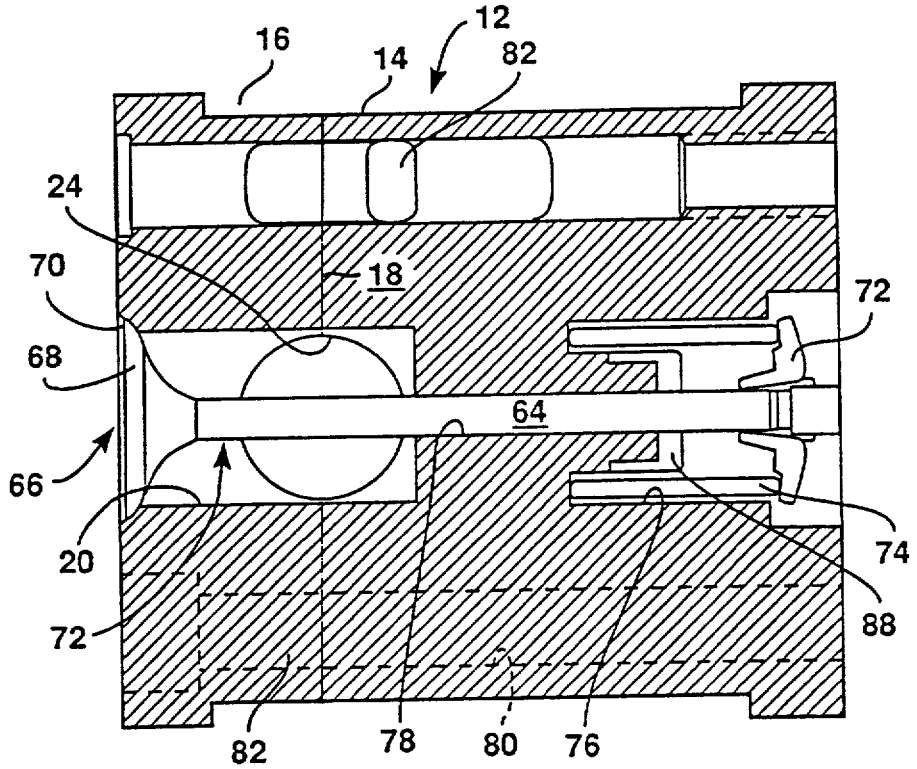

Change FIG. 2 to that shown below: